US005535546A

United States Patent [19]

Krivonos

[11] Patent Number: 5,535,546

[45] Date of Patent: Jul. 16, 1996

[54] PYRAMIDAL FLOWER DISPLAY

[76] Inventor: Eugene Krivonos, 565B Allenherst Rd., Amherst, N.Y. 14226

[21] Appl. No.: 386,950

[22] Filed: Feb. 10, 1995

[51] Int. Cl.[6] ..... A47G 7/00

[52] U.S. Cl. ..... 47/39; 47/83; 220/23.6; 206/507

[58] Field of Search ..... 47/41.01, 82, 83, 47/395; 312/238; 206/507; 220/23.6

[56] References Cited

U.S. PATENT DOCUMENTS

| | | | |
|---|---|---|---|
| D. 106,223 | 9/1937 | Tolleson . | |
| D. 191,812 | 11/1961 | Tirlet . | |
| D. 249,608 | 9/1978 | Wright . | |
| 253,877 | 2/1882 | Messler . | |
| 1,153,028 | 9/1915 | Chalk . | |
| 1,474,753 | 11/1923 | Zrebiec . | |
| 1,928,799 | 10/1933 | Stevens . | |
| 2,837,866 | 6/1958 | Esnay | 47/83 |
| 4,170,844 | 10/1979 | Steele | 47/39 |
| 4,190,384 | 2/1980 | Neumann . | |
| 4,255,896 | 3/1981 | Carl | 47/393 |
| 4,896,456 | 1/1990 | Grant | 47/83 |
| 5,269,095 | 12/1993 | Helfman | 47/39 |

FOREIGN PATENT DOCUMENTS

| | | | |
|---|---|---|---|
| 2609321 | 9/1977 | Germany | 47/83 |
| 3420037 | 12/1985 | Germany | 47/83 |
| 603118 | 8/1978 | Switzerland | 362/238 |
| 4960 | of 1906 | United Kingdom | 47/39 |
| 957455 | 9/1981 | United Kingdom | 47/83 |
| 2257897 | 1/1993 | United Kingdom | 312/238 |

*Primary Examiner*—Henry E. Raduazo
*Attorney, Agent, or Firm*—Richard C. Litman

[57] ABSTRACT

A pyramidal display stand for displaying a multi-tiered arrangement of flowers. The display includes a plurality of bedding trays mounted to a multi-tiered frame. The bedding trays are securely seated on the frame by symmetrically distributed tabs on the frame tiers cooperating with depressions built into the bottom of the trays. The bedding trays can be designed to include numerous geometric shapes including circular, rectangular, oval, hexagonal, and semi-circular. Runoff water is collected by a slidably mounted collecting drawer attached below the bottom bedding tray or mounted in the bottom tray itself.

6 Claims, 10 Drawing Sheets

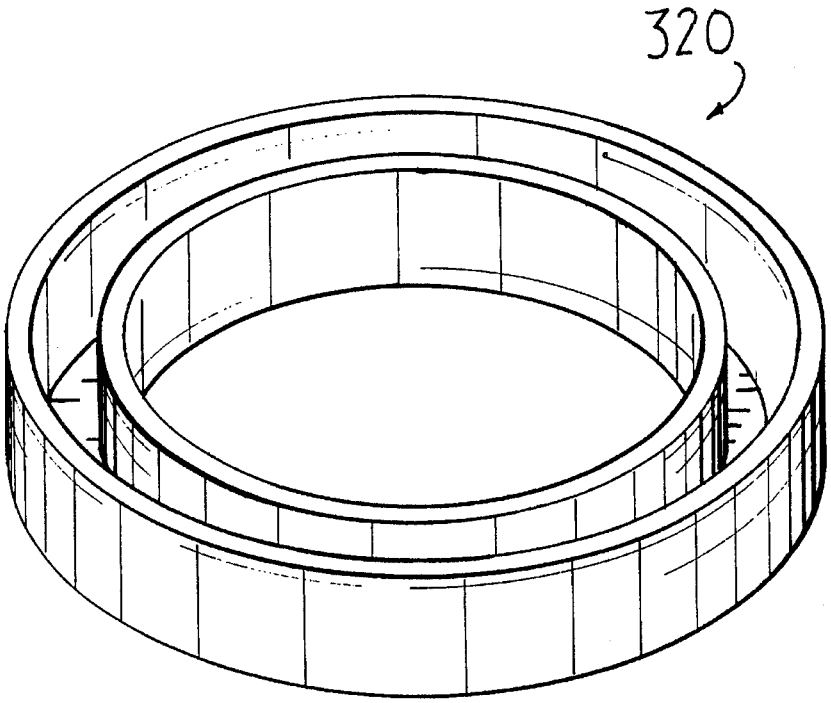
FIG. 8
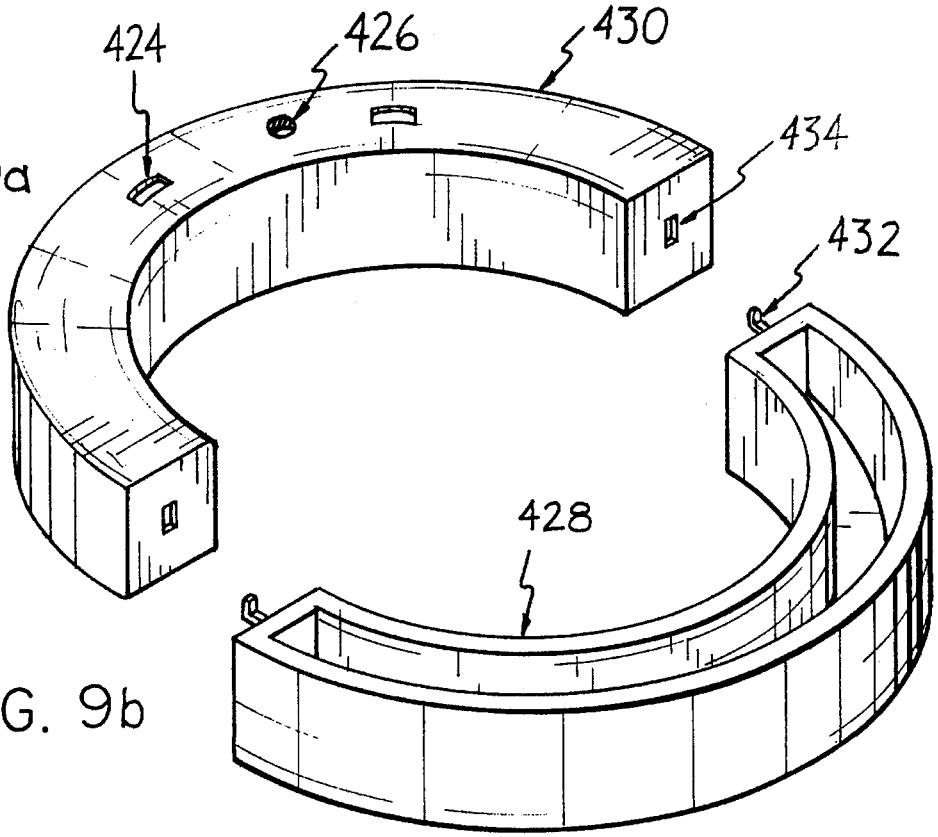
FIG. 9a
FIG. 9b

PYRAMIDAL FLOWER DISPLAY

BACKGROUND OF THE INVENTION

1. Field of the Invention

The present invention relates to a stand for displaying plants or floral arrangements in modular tiered and pyramidal bedding containers.

2. Description of the Prior Art

It is well known that flower displays can be used to enhance the sight and smell of almost any home, business, or outdoor area. But as space continues to be at a premium, the need to make the most of the space available remains an important concern. In the past, simple tiered displays have been used to effectively utilize floor space.

U.S. Pat. No. 253,877 issued to Messler on Feb. 21, 1882 shows one such circular, tiered stand. Each tier supports a pan for holding flowers. The three upper tiers rest with the lowest flower pan which collects runoff water from the higher tiers. No method is disclosed for emptying the collected water.

U.S. Pat. No. 1,153,028 issued to Chalk on Sep. 7, 1915 shows a different circular, tiered flower stand with a drip pan connected beneath the stand. Drainage of the drip pan is achieved through a draincock connected to the drip pan.

U.S. Pat. No. 1,474,753 issued to Zrebiec on Nov. 20, 1923 shows a flower stand with receiving holes built into the stand to receive flower pots. An accumulation receptacle beneath the shelf collects runoff water and includes a drain to discharge excess water from the receptacle.

U.S. Pat. No. 1,928,799 issued to Stevens on Oct. 3, 1933 shows a three tiered pyramidal flower stand resting within a drainage pan. Runoff from each of the tiers is collected within the drainage pan. In one embodiment of the invention, a drainage pipe connected to the drainage pan discharges excess water in the pan.

U.S. Pat. No. 4,190,384 issued to Neumann on Feb. 26, 1980 shows concrete construction elements for erecting walls to accommodate plants.

U.S. Pat. No. 106,223 issued to Tolleson on Sep. 28, 1937 shows an ornamental configuration of a hexagonal, tiered display stand.

U.S. Pat. No. 191,812 issued to Tirlet on Nov. 21, 1961 shows an ornamental construction of a round, tiered display stand with basket type shelving.

U.S. Pat. No. 249,608 issued to wright on Sep. 26, 1978 shows an ornamental construction of a hexagonal, tiered display stand.

However, none of the prior art devices provided an easily assembled, secure display stand with an integral water collection system that operated independent of available plumbing lines. In order to take advantage of the spaces available in an office or home, it is necessary for the flower stand to be both space efficient and easily insertable at any spot in the room, whether on the floor, on the wall, or in a corner.

None of the above inventions and patents, taken either singly or in combination, is seen to describe the instant invention as claimed.

SUMMARY OF THE INVENTION

The present invention discloses a novel and new approach to providing a modular construction with a removable water drainage pan requiring only a limited amount of space to display a large amount of flowers. The bedding trays may be built to reflect the design of various geometric figures or to match the space available.

The flower stand displays floral or plant arrangements in modular tiered and pyramidal bedding containers. The bedding containers are designed for indoor or outdoor use and are easily manufactured from any of a various materials, such as wood, metal, and preferably plastic. The indoor flower display stands have additional water overflow protection means through incorporating a special drawer beneath the bedded plants.

Accordingly, it is a principal object of the invention to provide a space efficient display for flowers which can stand alone or be mounted on a wall.

It is another object of the invention to provide a flower display with a convenient and easily removable water collection drawer which the display to be set up independent of existing plumbing.

It is a further object of the invention to provide a flower display with a symmetric, geometric modular design which can be easily assembled or disassembled.

Still another object of the invention is to provide a stable and easily assembled flower display with a novel means of securely affixing modular flower bedding trays to an internal frame.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 8 is a perspective view of a flower display stand bedding tray according to a third embodiment of the invention.

FIG. **9*a*** is a bottom perspective view of a flower display stand sectional bedding tray according to a forth embodiment of the invention.

FIG. **9*b* is a top perspective view of a flower display stand sectional bedding tray which mates with the bedding tray shown in FIG. 9*a***, according to a forth embodiment of the invention.

Figure 10:
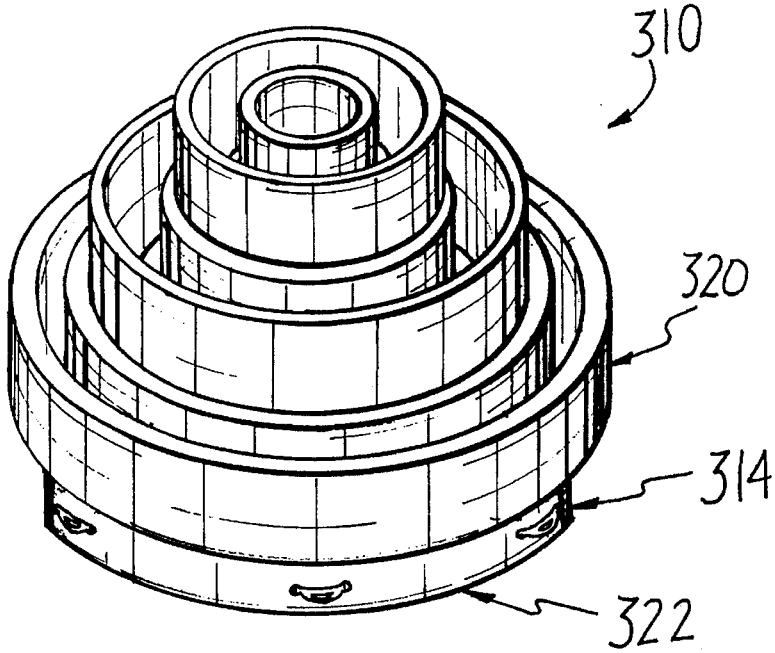

FIG. 10 is a perspective view of a flower display stand according to a third embodiment of the invention.

Figure 11:
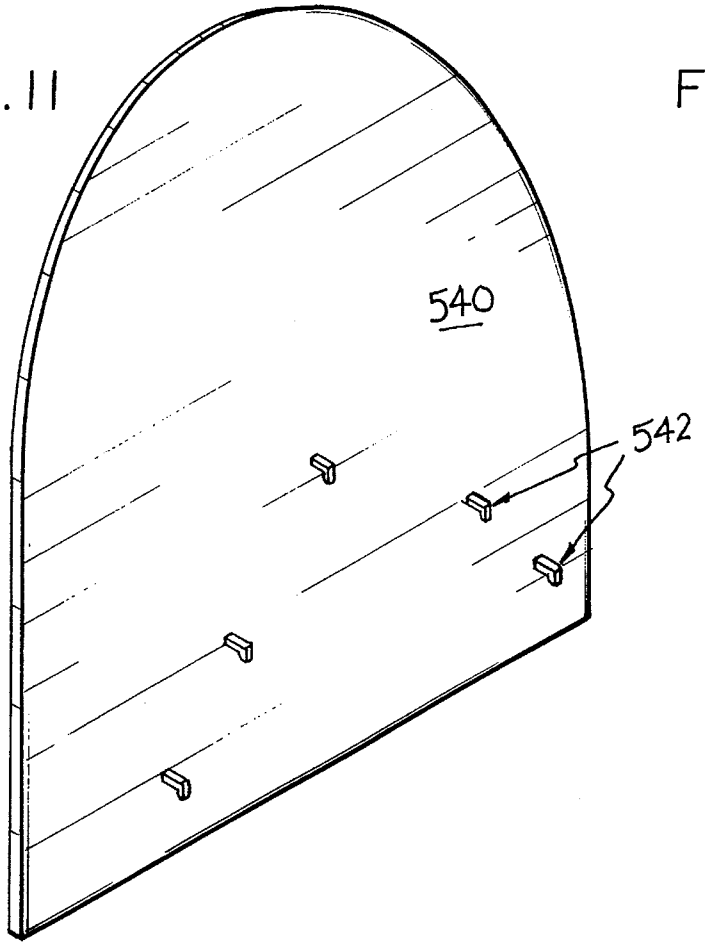

FIG. 11 is a diagrammatic, rear perspective view of a flower display stand wall mounting system according to a fifth embodiment of the invention.

Figure 12:
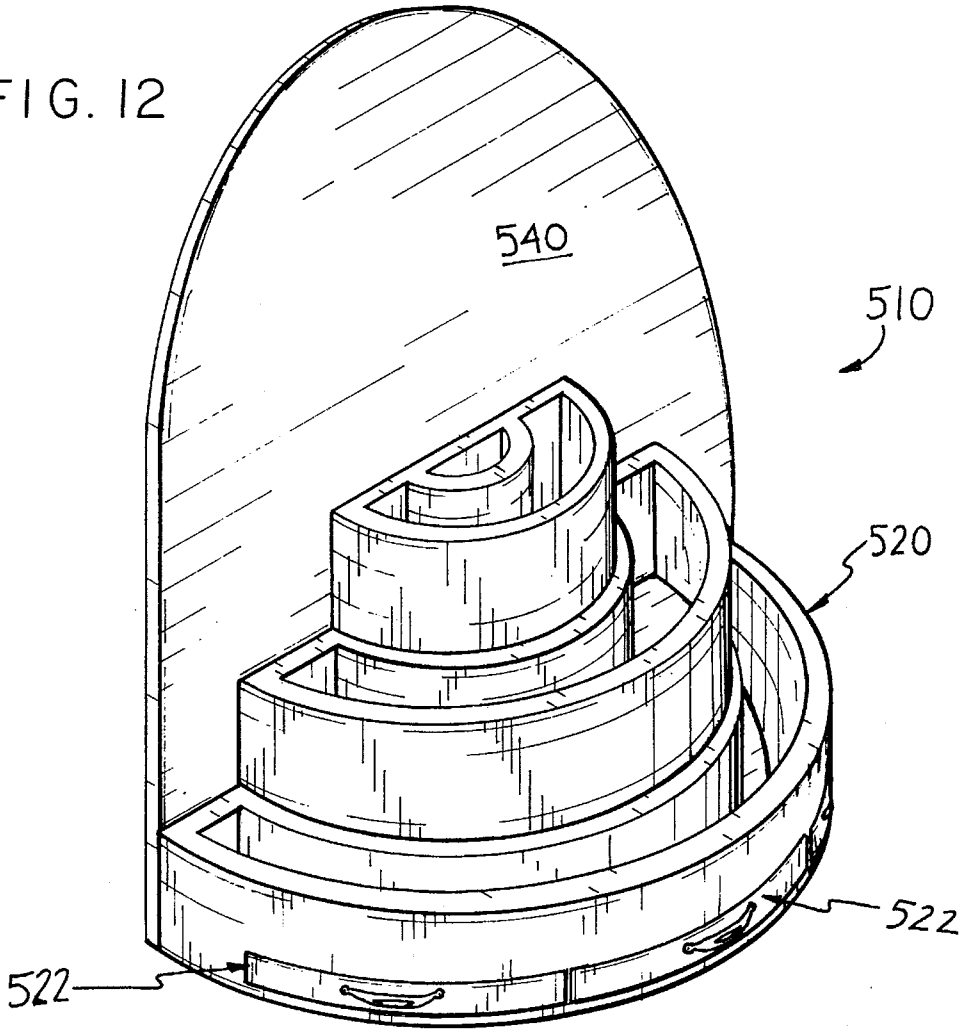

FIG. 12 is a front perspective view of a wall mounted flower display stand according to a fifth embodiment of the invention.

Figure 13:
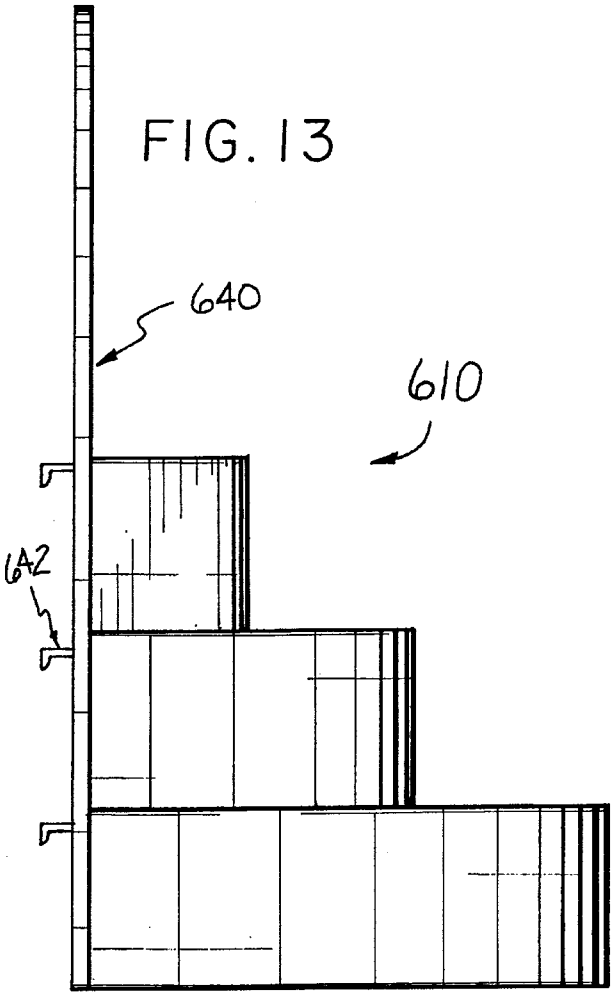

FIG. 13 is a side elevation view of a wall mounted flower display stand according to a sixth embodiment of the invention.

Figure 14:
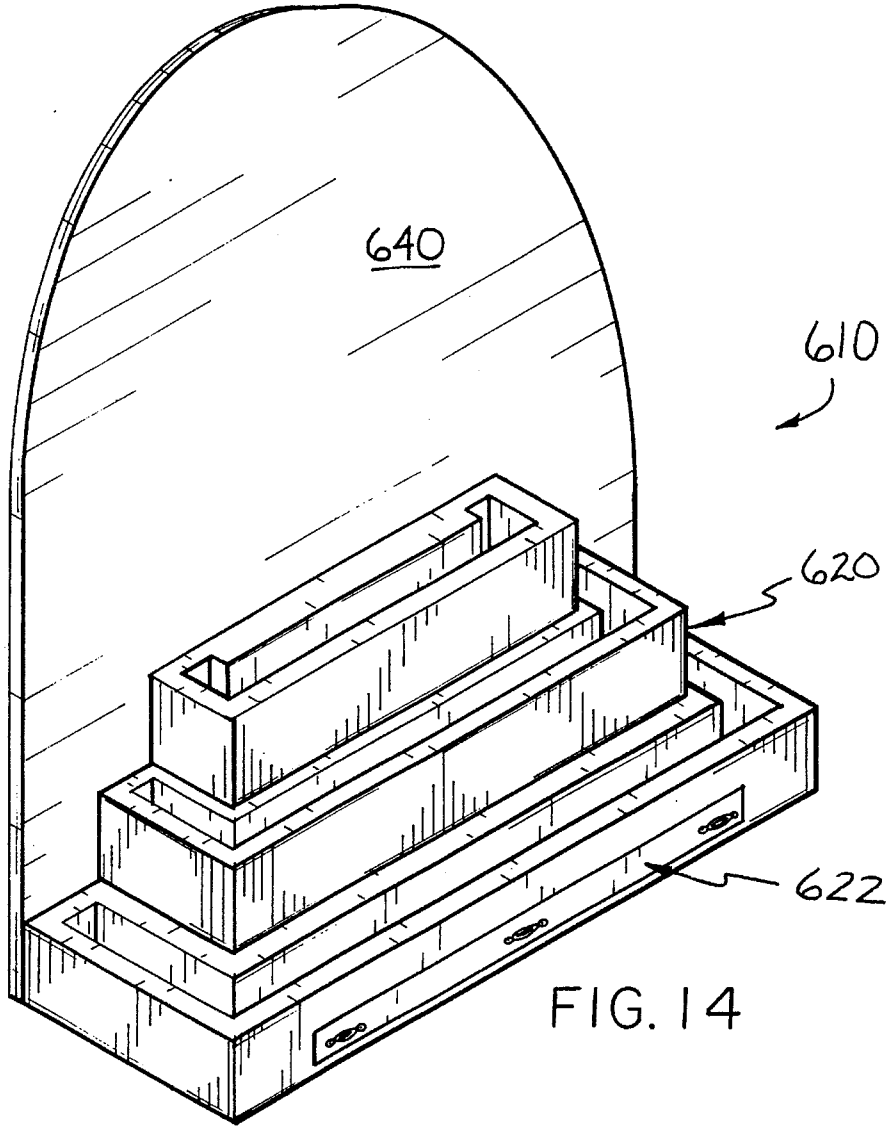

FIG. 14 is a perspective view of a wall mounted flower display stand according to a sixth embodiment of the invention.

Figure 15:
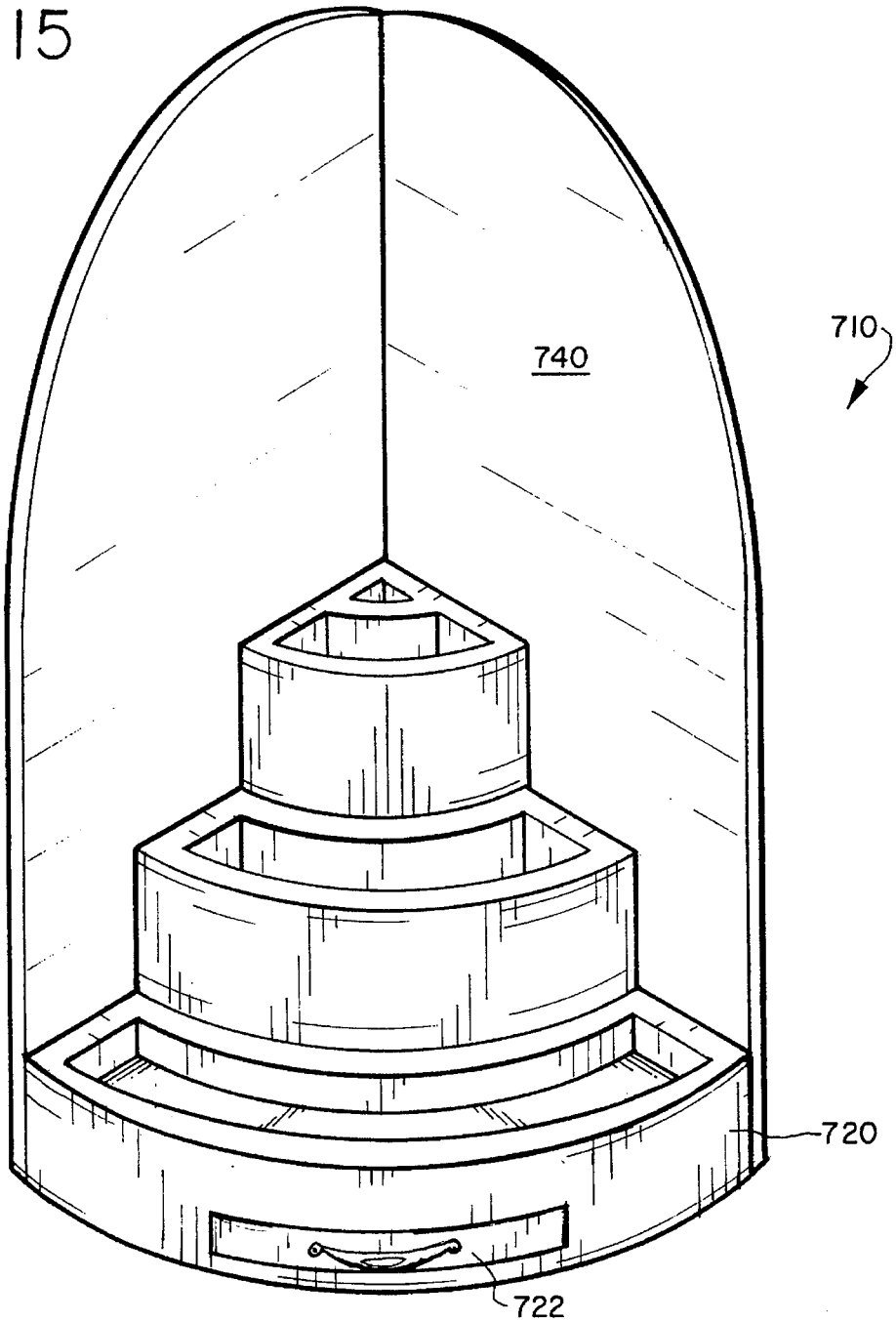

FIG. 15 is a perspective view of a seventh embodiment of a wall mounted flower display stand.

Figure 16:
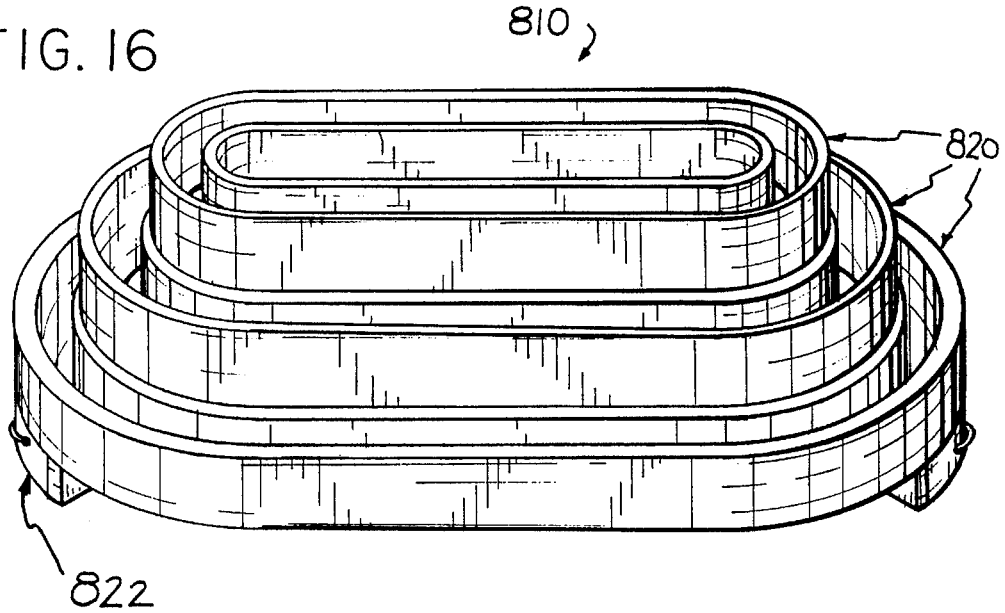

FIG. 16 is a perspective view of a flower display stand according to an eighth embodiment of the invention.

Figure 17:
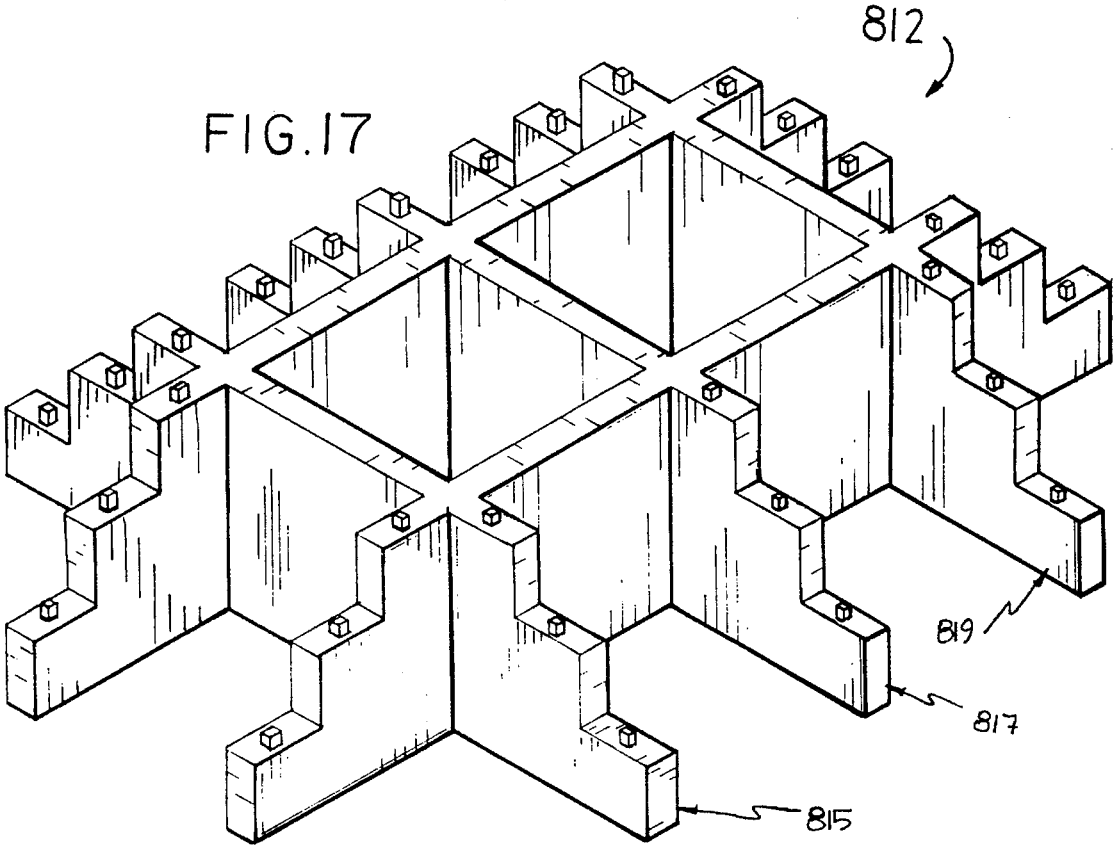

FIG. 17 is a perspective view of a flower display stand internal frame according to an eighth embodiment of the invention.

Similar reference characters denote corresponding features consistently throughout the attached drawings.

DETAILED DESCRIPTION OF THE PREFERRED EMBODIMENTS

The present invention relates to a stand for displaying floral or plant arrangements in modular tiered and pyramidal bedding containers. The various embodiments and geometric configurations of the flower display stands and their construction will be explained in greater detail with reference to the drawings.

Figure 1:
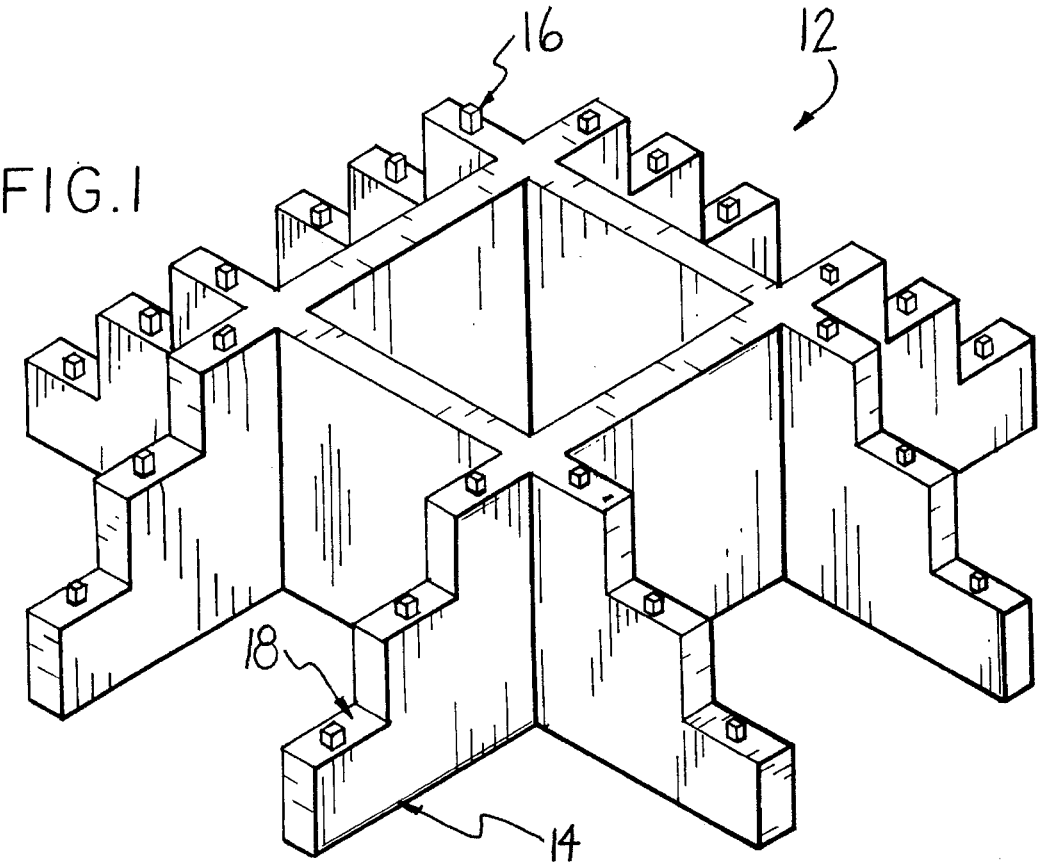
FIG. 1 is perspective view of a flower display stand internal frame according to a first embodiment of the invention.
Figure 4:
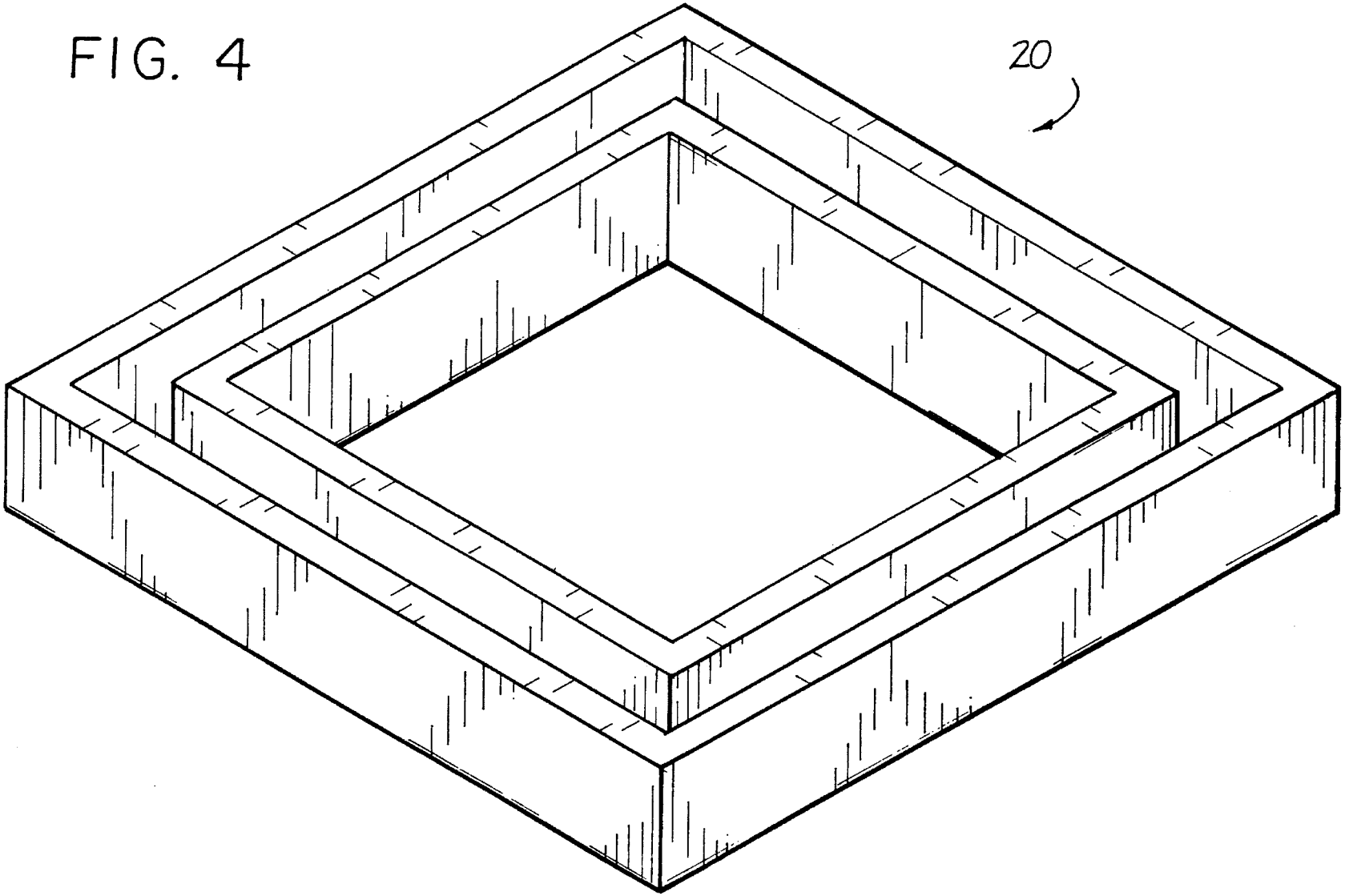
FIG. 4 is a perspective view of a bedding tray according to a first embodiment of the invention.
Figure 6:
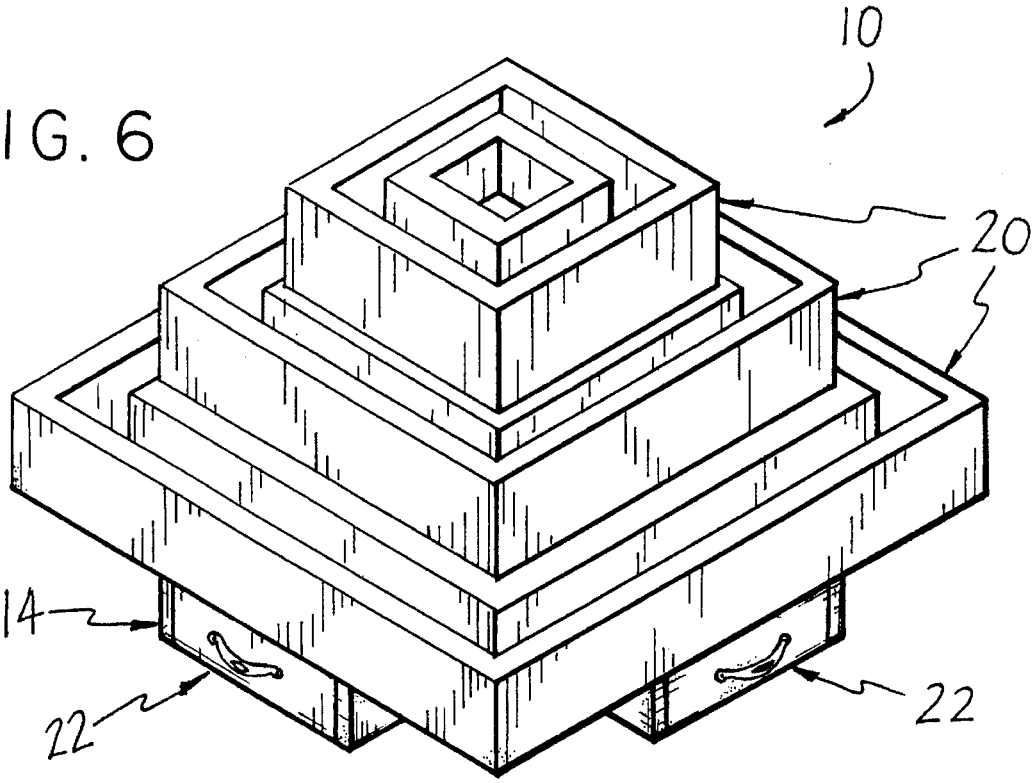
FIG. 6 is a perspective view of a flower display stand assembled according to a first embodiment of the invention.

FIGS. 1, 4, and 6 show a multi-tiered flower display stand 10 according to a first embodiment of the present invention. The display stand 10 is made up of an internal frame 12 and a plurality of rectangular bedding trays 20 sized to fit on each step or tier 18 of the frame. In the first embodiment as shown in FIGS. 1, 4, and 6, the internal frame 12 is a one-piece unit shaped like a "tic-tac-toe" board, with two sets of equal length, parallel boards 14 intersecting each other at right angles.

Each bedding tray 20 is a shallow rectangular tray with an inner edge proportioned to fit a respective tier 18 of the frame. A depression 424 (see FIG. 9*a*) in the bottom of each tray mates with a tab 16 on each tier 18 to securely position the tray on the step.

When the display stand is assembled, as shown in FIG. 6, the trays stack together on top of the frame to form a pyramidal display. The individual trays 20 are sized such that the outer edge of a higher tray is in close proximity to the inner edge of a lower tray. The close fit prevents water from spilling through the space between the trays to the floor below. Also, any excess water which spills from a tray in an-upper tier falls into a lower tray. The lowest tray is provided with an interior passage 426 (see FIG. 9*a*) in communication with at least one collecting drawer 22 slidably mounted to the frame below the lowest tray. The drawer collects the excess water from the bedding trays and is easily removable so that it may be emptied to prevent excess water from accumulating.

Figure 2:
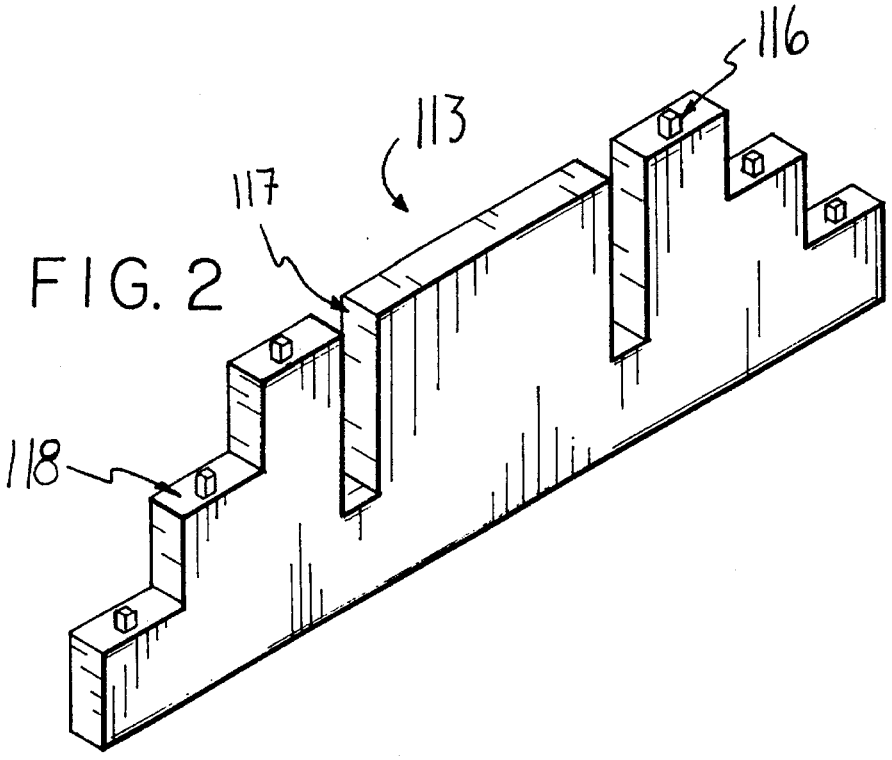
FIG. 2 is a perspective view of a flower display stand female frame section according to a second embodiment of the invention.
Figure 3:
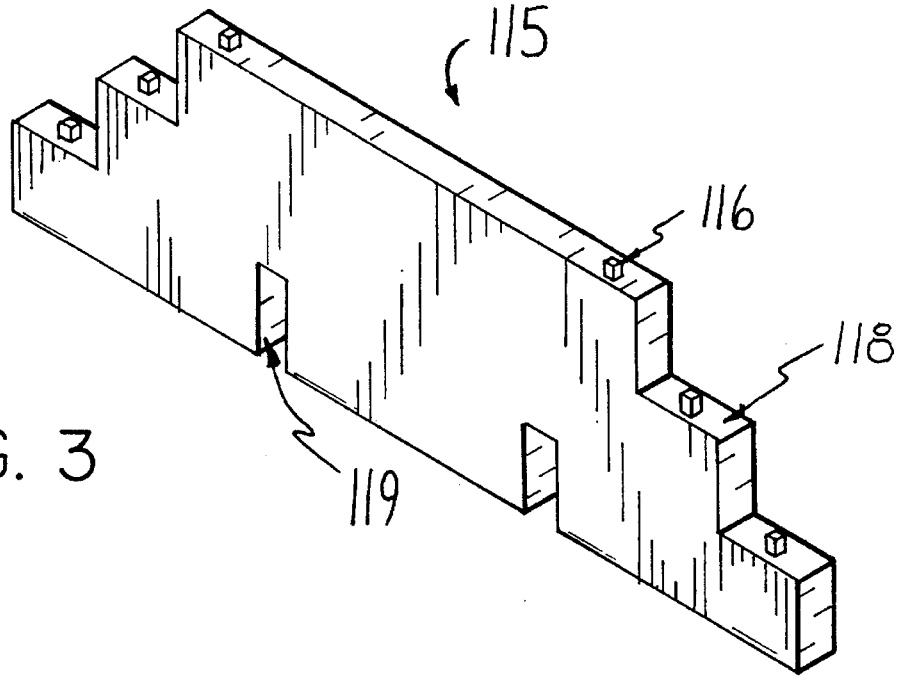
FIG. 3 is a perspective view of a flower display stand male frame section according to a second embodiment of the invention.

Referring now to FIGS. 2 and 3, a second embodiment according to the present invention is shown for constructing a pyramidal flower display with sectional frame and bedding tray elements. FIGS. 2 and 3 show the male and female elements of the internal frame. The female frame board-113 has an elongated vertical slot 117 to receive a shorter slot 119 of the male frame board 115. By assembling two male frame boards and two female frame boards together, a frame identical in function to the frame 12 of the first embodiment is constructed. The sectional frame of the second embodiment has the further advantage of disassembling to a more compact form.

Figure 5:
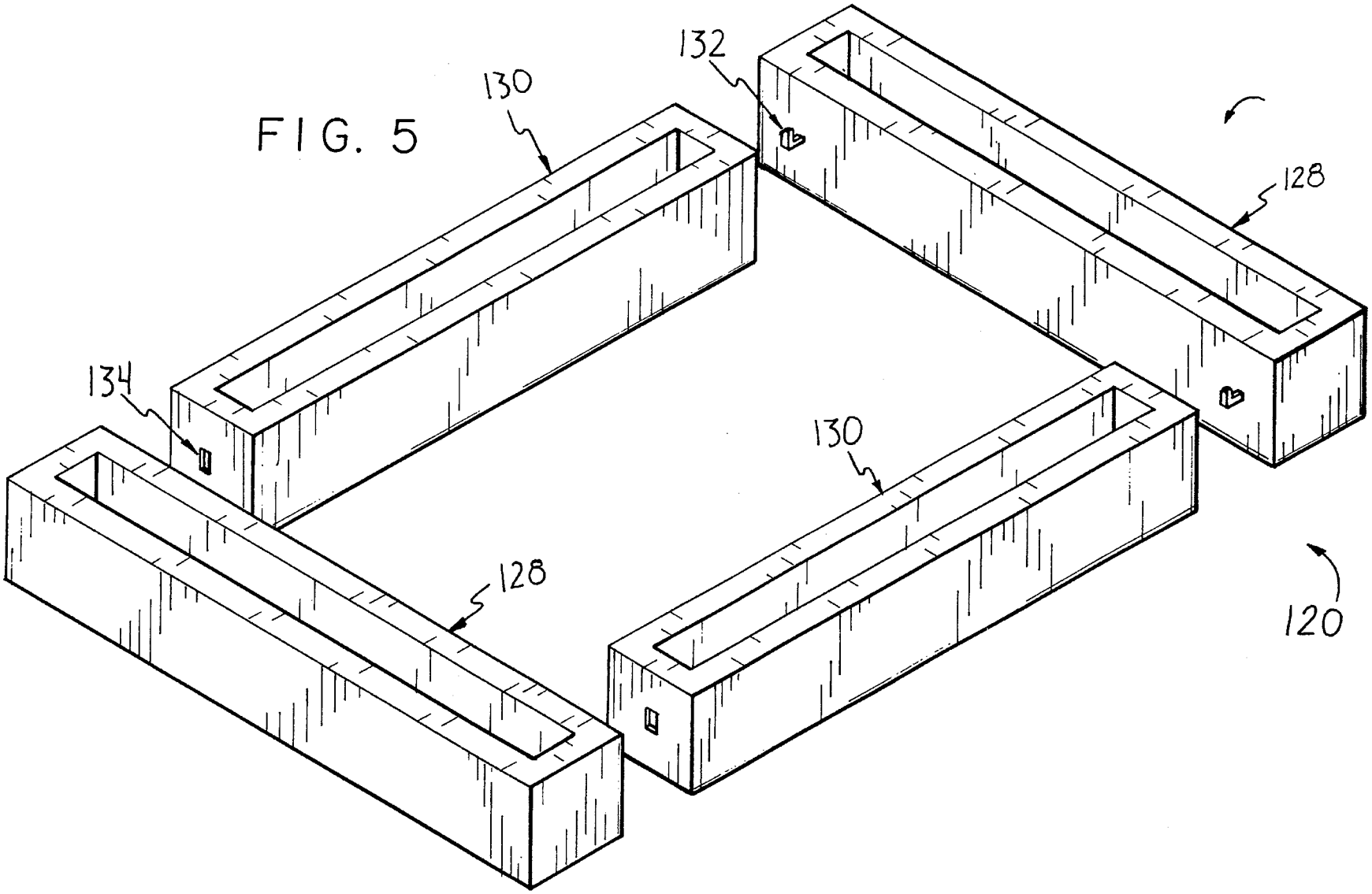
FIG. 5 is a perspective view of a flower display stand sectional bedding tray according to a second embodiment of the invention.

The bedding trays 120 of each tier of the second embodiment as shown in FIG. 5 are also sectional for compact storage when the display is not in use. The two male bedding tray sections 128 are provided with a male catch 132 which cooperates with a slot 134 on each of the two female tray sections 130 to secure the four trays together to form one rectangular bedding tray 120. Each bedding tray 120 is then assembled onto a tier 118 of the sectional frame 113, 115. Operation of the flower display stand is otherwise as described in reference to the display stand of the first embodiment. Multiple collecting drawers 22 may be provided below the bottom tier of the display stand, such that each bedding tray section 128,130 communicates with at least one collecting drawer 22.

Figure 7:
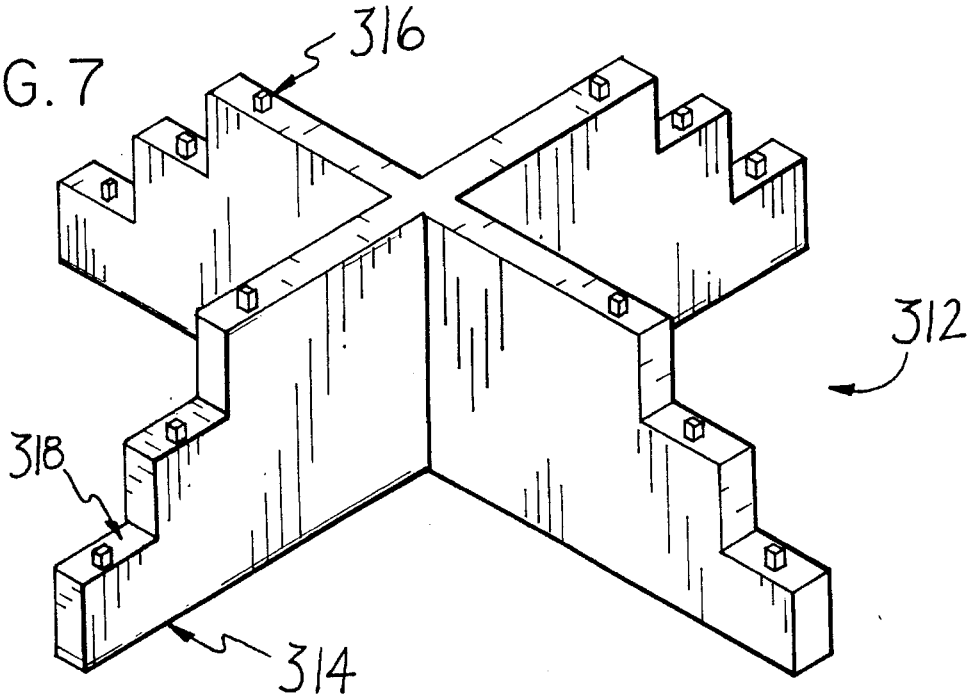
FIG. 7 is a perspective view of a flower display stand internal frame according to a third embodiment of the invention.

Referring now to FIGS. 7, 8, and 10, a third embodiment of a flower display stand according to the present invention will be described. A cross-shaped frame 312 is provided with a plurality of tabs 316 on each tier 318 of its four legs 314. Each tier is dimensioned to receive one bedding tray 320 thereon. Each bedding tray 320 is circular and has a plurality of depressions 424 (see FIG. 9*a*) on its lower side to mate with the respective tabs 320 of the frame. The flower display 310, shown in FIG. 10 when assembled, has a collecting drawer 322 mounted beneath and in communication with the lowest bedding tray 320 to collect runoff water in the drawer.

FIGS. 9*a* and 9*b* show an alternate, fourth embodiment of a flower display according to the present invention with sectional bedding elements. Each bedding tray is made of a plurality of bedding tray sections 428,430. Two sections have been shown in the drawings for the purpose of explanation. A first bedding tray section 428 has a male catch 432 at each end to mate with female slots 434 provided in the female bedding tray sections 430. FIG. 9*a* is a bottom perspective view which shows the details of each bedding tray section with at least one depression 424 which cooperates with a respective tab 16 (FIG. 1), 116 (FIG. 2 or 3), and 316 (FIG. 7) on a frame. Here the depressions 424 are shown dimensioned to mate with the frame 12 (FIG. 1), 113 (FIG. 2), 115 (FIG. 3) of the first or second embodiment. The joined bedding tray sections 428,430 form one complete bedding tray which can be mounted on frame member 10 (FIG. 1). A drain hole 426 is shown in FIG. 9*a* to provide communication between the bedding tray section 430 and a collecting drawer.

FIGS. 11 and 12 show a wall mounted display stand according to a fifth embodiment of the invention. A backing plate 540 supports the bedding trays 520 and internal frame (not shown). In this embodiment, the trays 520 are semicircular and mount to a frame integral with the backing plate 540. The back of the mounting plate, as shown in FIG. 11, has a plurality of mounting hooks 542 to mount the flower display stand on a wall or other suitable vertical surface. Separate drawers 522 are provided in communication with the lowest bedding tray to collect run off water. In this embodiment, the drawers are mounted integral with the lowest bedding tray to enhance the appearance of the display.

FIGS. 13 and 14 show a wall mounted flower display stand according to a sixth embodiment of the invention. The operation and structure of the flower display stand 610 is identical to the operation and structure of the fifth embodiment (shown in FIG. 12), except that the bedding trays 620 are rectangular rather than semicircular to provide a novel way to display flowers on a wall or other vertical surface. FIG. 13 shows a side plan view of the mounting hooks 642 which are attached to the backing plate 640 of the flower display stand. A single collecting drawer 622 has been provided in the front center of the lowest bedding tray to collect runoff water.

FIG. 15 shows a wall mounted flower display stand according to a seventh embodiment of the invention. The operation and structure of the flower display stand 710 is identical to the flower display stand 510 of the fifth embodiment, except that the stand has been constructed to be mounted in a corner space of a wall. The backing plate 740 is constructed of two perpendicular sections which support a plurality of quarter-circle shaped bedding trays 720. A single collecting drawer 722 is provided in the lowest bedding tray 720 to collect run off water.

FIGS. 16 and 17 show an eighth embodiment of a flower display stand according to the present invention. The flower display 810 has oval bedding trays 820 which mount to an internal frame 812 in the manner discussed with reference to the first embodiment. The elongated internal frame 812 has three cross frame members 815, 817, 819 in one direction to support the elongated oval bedding trays 820. At least one collecting drawer 822 is provided beneath the lowest bedding tray 822 to collect runoff water from the bedding trays.

It is to be understood that the present invention is not limited to the sole embodiment described above, but encompasses any and all embodiments within the scope of the following claims. It is readily apparent that the sectional bedding trays are interchangeable with the one piece bedding trays, and likewise the sectional frames are interchangeable with the one piece frames. A single frame may be proportioned to receive either a round or rectangular bedding tray. Also the flower display stand could be modified to use numerous other shapes of bedding trays and numbers of tiers, though the trays are preferably made of symmetric geometric shapes.

I claim:

1. A modular stand assembly for displaying flower arrangements comprising:

a plurality of bedding trays including at least a top bedding tray and a bottom bedding tray;

an internal frame having a plurality of tiers to support said bedding trays, wherein each of said tiers includes securing means to securely affix said bedding trays to said internal frame;

said internal frame being mounted to a backing plate having mounting hooks to attach said backing plate to a vertical surface, and wherein said internal frame is hidden by said bedding trays; and a collecting drawer communicating with said bottom bedding tray to collect drainage fluid, whereby said modular stand assembly can be easily assembled and disassembled.

2. The stand assembly according to claim 1, wherein said bedding trays include a cooperating securing means which mates with said securing means on said frame to affix said bedding trays to said internal frame.

3. The stand assembly according to claim 2, wherein said cooperating securing means on said bedding tray includes a depression in said bedding tray for receiving said securing means on said frame.

4. The stand assembly according to claim 1, wherein said securing means includes at least one tab attached to each of said tiers and at least one depression in a bottom surface of each of said bedding trays, whereby said at least one tab cooperates with said at least one depression to non-movably locate said bedding tray on said internal frame.

5. The stand assembly according to claim 1, further comprising a passage between said bottom bedding tray and said collecting drawer.

6. The stand assembly according to claim 1, wherein said backing plate includes two perpendicular sections, whereby said mounting plate mounts to a corner of a wall.

* * * * *